US007963108B2

(12) United States Patent
Cornwell

(10) Patent No.: US 7,963,108 B2
(45) Date of Patent: Jun. 21, 2011

(54) MULTI-STAGE REGULATION OF EXHAUST BACK PRESSURE

(75) Inventor: Gary R. Cornwell, Melbourne, FL (US)

(73) Assignee: Hi-Velocity Technology, Inc., Rochester, NY (US)

( * ) Notice: Subject to any disclaimer, the term of this patent is extended or adjusted under 35 U.S.C. 154(b) by 1394 days.

(21) Appl. No.: 11/382,998

(22) Filed: May 12, 2006

(65) Prior Publication Data

US 2007/0261402 A1 Nov. 15, 2007

(51) Int. Cl.
*F02B 27/02* (2006.01)

(52) U.S. Cl. ..... 60/312; 60/274; 60/314; 60/324

(58) Field of Classification Search ..... 60/312, 60/314, 324, 274
See application file for complete search history.

(56) References Cited

U.S. PATENT DOCUMENTS

| | | | | |
|---|---|---|---|---|
| 2,110,986 | A | 3/1938 | Kadenacy | |
| 3,670,502 | A | 6/1972 | Firey | |
| 3,969,895 | A | 7/1976 | Krizman | |
| 4,051,821 | A | 10/1977 | Amann | |
| 4,378,003 | A | 3/1983 | Imamura | |
| 5,743,088 | A * | 4/1998 | Grath | 60/324 |
| 5,785,014 | A | 7/1998 | Cornwell | |
| 6,233,926 | B1 | 5/2001 | Bailey et al. | |
| 6,901,752 | B2 * | 6/2005 | Uhler et al. | 60/312 |
| 6,968,680 | B2 | 11/2005 | van Nieuwstadt et al. | |

FOREIGN PATENT DOCUMENTS

| | | | |
|---|---|---|---|
| JP | 357102508 | A | 6/1982 |
| JP | 360162006 | A | 8/1985 |

* cited by examiner

*Primary Examiner* — Thomas E Denion
*Assistant Examiner* — Diem Tran
(74) *Attorney, Agent, or Firm* — Stephen B. Salai, Esq.; Thomas B. Ryan, Patent Agent; Harter Secrest & Emery LLP

(57) ABSTRACT

An exhaust system for a two-cycle engine includes an exhaust conduit having both a bypass port and a regulator port for discharging exhaust gases to atmosphere. The bypass port has a fixed size but the regulator port has a variable size that varies over the range of engine speeds. Within a low range of operating speeds, the regulator valve is at least partly closed. Within a mid range of operating speeds, the regulator valve is progressively opened with increases in the operating speed. Within a high range of operating speeds, the regulator valve is progressively closed with further increases in the operating speed.

33 Claims, 4 Drawing Sheets

MULTI-STAGE REGULATION OF EXHAUST BACK PRESSURE

FIELD OF THE INVENTION

The invention relates to exhaust systems for two-cycle engines and in particular to valves and other structures used to regulate exhaust back pressures for influencing engine operation.

BACKGROUND OF THE INVENTION

Intake and exhaust cycles overlap in two-cycle engines. Through a range of piston positions, fresh air and fuel enter the combustion chamber through an intake port at the same time that exhaust gases leave the combustion chamber through a regulator port. Exhaust gas back pressures from an exhaust system can affect both cycles.

Different objectives can be set for two-cycle engine performance and different exhaust back pressures can be optimal for these different objectives. Optimal back pressures also tend to vary over the operating range of two-cycle engines. Most exhaust systems adopt a geometric form for optimizing both dynamic and static exhaust back pressures. For example, specially shaped exhaust conduits have been developed to manage pressure pulses associated with the cyclical nature of the exhaust discharges. Constricted exhaust flow paths, such as provided by limited size outlet pipes, can be used to affect overall exhaust back pressures.

Valves for controlling resistance to exhaust flows have also been used. Some such valves have been arranged to maintain more constant back pressures over a range of engine speeds. Others have sought to lower resistance to exhaust flows at low speeds or light load operations. For example, U.S. Pat. No. 4,051,821 to Amann mounts a butterfly valve along an exhaust passage. A hydraulic control system powered by an engine-driven oil pump moves the butterfly valve between open and closed positions as a result of a feedback pressure in the exhaust passage.

U.S. Pat. No. 3,969,895 to Krizman discloses an exhaust flow regulating valve operated by back pressures within an exhaust conduit. The valve includes a closure plate that is biased against an open end of the exhaust conduit. A perforated tube carried by the closure fits inside the open end of the exhaust conduit. Exhaust back pressures displace the closure plate allowing exhaust gases to discharge through and around the perforated tube to atmosphere. A spring bias controls the amount the closure plate and perforated tube are displaced by the exhaust back pressures.

My earlier U.S. Pat. No. 5,785,014 provides for further regulating exhaust back pressures of two-cycle engines by combining a biased back pressure sensitive piston with a cross-sectional flow area that varies non-linearly with displacements of the piston. In particular, the cross-sectional flow area of the exhaust passageway increases non-linearly in response to back pressure induced displacements of the piston. Overall, the exhaust system significantly reduces restriction to airflow as back-pressure otherwise increases.

SUMMARY OF THE INVENTION

The invention improves performance opportunities for two-cycle engines over a wide range of operating speeds. Optimal back pressures can be reached by establishing a pattern of resistance to the discharge of exhaust gases over a range of engine speeds. Power gains at top-end speeds can be achieved while preserving low-end performance efficiencies.

One version of the invention as an exhaust system for regulating exhaust flows from a two-cycle engine includes an exhaust conduit for conveying exhaust gases from the two-cycle engine, a port formed in the exhaust conduit for discharging the exhaust gases from the exhaust conduit, and a valve that is responsive to exhaust flows through the exhaust conduit by progressively opening the port in response to increasing exhaust flows and by at least partially closing the port in response to further increasing exhaust flows. Preferably, the valve imposes a predetermined resistance to the exhaust flows in the exhaust system at low range of operating speeds of the two-cycle engine but progressively decreases the resistance to the exhaust flows through a mid range of increasing operating speeds. Entering a higher range of operating speeds, the preferred valve progressively increases the resistance to the exhaust flows with the further increases in operating speeds of the two-cycle engine.

The preferred valve includes a displacement member that is movable along the exhaust conduit in response to changes in exhaust flows through the exhaust conduit. The port has an adjustable size that varies with the movement of the displacement member along the exhaust conduit. The size of the port progressively increases through a first range of movement of the displacement member and progressively decreases through a second range of movement of the displacement member in the same direction along the exhaust conduit.

The preferred exhaust conduit has an open end for receiving exhaust flows from the two-cycle engine, a closed end, and a sidewall in which the port is formed. The preferred displacement member has a head that is exposed to the exhaust flows and a sidewall that is aligned with the sidewall of the exhaust conduit for adjusting the size of the port. The port is preferably one of a plurality of ports and another of the ports has a fixed size for bypassing exhaust flows in advance of the valve.

Another version of the invention as an exhaust system for regulating exhaust flows from a two-cycle engine includes an exhaust conduit for conveying exhaust gases from the two-cycle engine, first and second ports formed in the exhaust conduit for discharging the exhaust gases from the exhaust conduit, and a valve for regulating the discharge of the exhaust gases from the exhaust conduit. The first port has a fixed size along the exhaust conduit for discharging exhaust gases independently of the valve. The second port has an effective size adjusted by the valve for regulating back pressures in the exhaust conduit.

Preferably, the first port is located along the exhaust conduit in advance of the second port in the direction of exhaust flow within a substantially conical section of the exhaust conduit. The second port is preferably located within a substantially cylindrical section of the exhaust conduit. A shroud can be used to at least partially cover the second port for protecting the valve from effects of external exposure.

The adjustable size second port has a variable cross-sectional area and the fixed size first port has a constant cross-sectional area. The valve preferably includes a displacement member that is movable along the exhaust conduit in response to changes in exhaust flows through the exhaust conduit. Preferably, the flow cross-sectional area of the adjustable size second port varies linearly with the movement of the displacement member along the exhaust conduit. The preferred valve responds to exhaust flows through the exhaust conduit by (a) progressively opening the second port in response to increasing exhaust flows and (b) progressively closing the second port in response to further increasing exhaust flows.

Another version of the invention as a valve system for regulating exhaust flows from a two-cycle engine includes a valve body containing a port for directing exhaust gases from the two-cycle engine toward atmosphere and a displacer that is relatively moveable with respect to the valve body in response to exhaust flows through the valve body for regulating an effective size of the port. The displacer responds to increasing exhaust flow rates through the valve body by (a) increasing the effective size of the port within a first lower range of the increase in exhaust flow rates and (b) decreasing the effective size of the port within a second higher range of the increase in exhaust flow rates.

The preferred displacer includes an opening that is movable into and out of alignment with an opening in the valve body for increasing and decreasing the effective size of the port. For example, the displacer can be formed as a piston having a head exposed to the exhaust flow and a sidewall containing the opening in the displacer that is movable into and out of alignment with the opening in the valve body.

The preferred valve body is formed in an exhaust conduit of an exhaust system for the two-cycle engine and the opening in the valve body is formed in a sidewall of the exhaust conduit. The piston is displaceable by exhaust flows within the exhaust conduit for moving the opening in the sidewall of the piston into and out of alignment with the opening in the exhaust conduit. The preferred valve body includes open and closed ends. The open end receives exhaust flows, and a biasing member is located between the piston and the closed end of the valve body for initially positioning the opening in the sidewall of the piston with respect to the opening in the sidewall of the exhaust conduit. The openings in the valve body and the displacer can have rectangular forms so that the effective size of the port increases and decreases linearly with the movement of the displacer with respect to the valve body.

Preferably, a bypass port separately directs exhaust gases from the two-cycle engine toward the atmosphere. The preferred bypass port has a fixed size through which the exhaust gases are directed toward the atmosphere.

The invention also includes a method of controlling resistance to exhaust flows in an exhaust system of a two-cycle engine. For example, the invention provides for imposing a resistance to the exhaust flows in the exhaust system at low range of operating speeds of the two-cycle engine. The resistance to the exhaust flows in the exhaust system progressively decreases through a mid range of increasing operating speeds. However, the resistance to the exhaust flows in the exhaust system increases at a high range of operating speeds of the two-cycle engine.

Preferably, the increase in resistance is a progressive increase in resistance to the exhaust flows in the exhaust system through the high range of increasing operating speeds. The resistance to the exhaust flows is preferably provided by a valve that progressively opens in response to exhaust flows associated with increasing operating speeds of the two cycle engine within the mid range of engine speeds and progressively closes in response to exhaust flows associated with further increasing operating speeds of the two-cycle engine within the high range of engine speeds. In addition, the invention provides for bypassing the resistance with a portion of the exhaust flow to atmosphere.

BRIEF DESCRIPTION OF THE DRAWING FIGURES

Figure 4A:
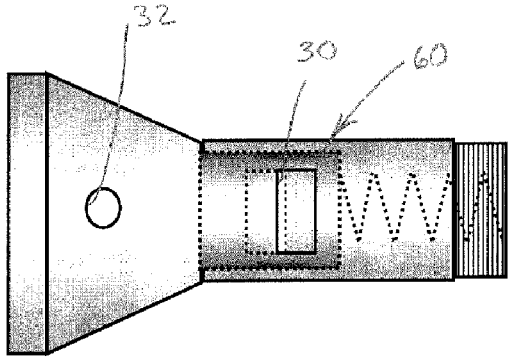
Figure 4B:
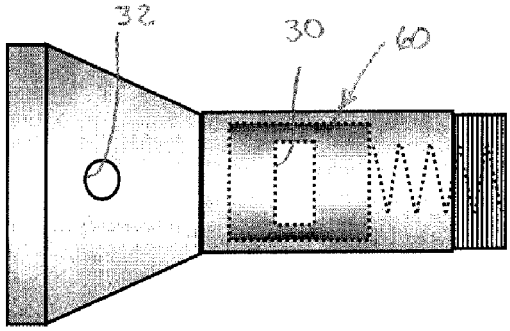
Figure 4C:
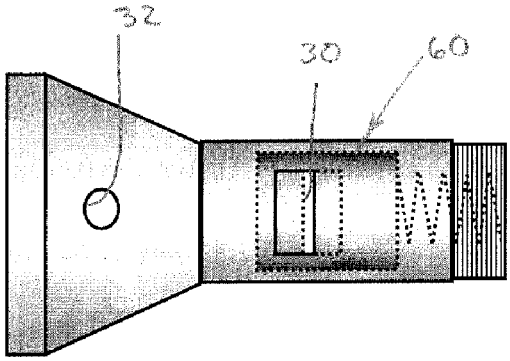

FIGS. 4A-C are side views depicting the operation of a valve for regulating the size of the regulator port within a low range, mid range, and high range of engine speeds.

Figure 5A:
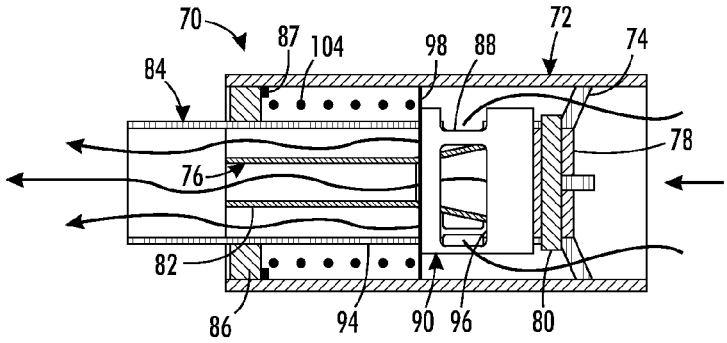
Figure 5B:
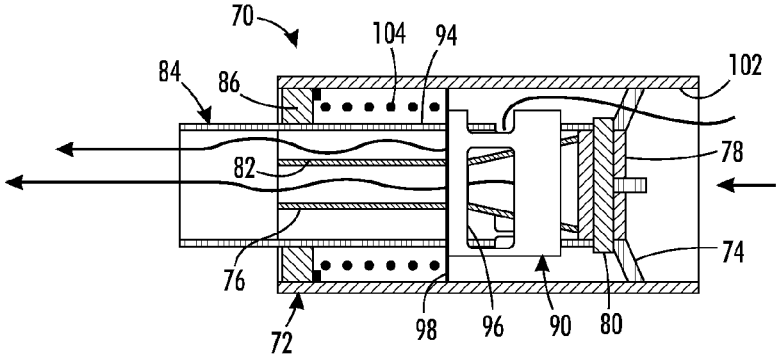
Figure 5C:
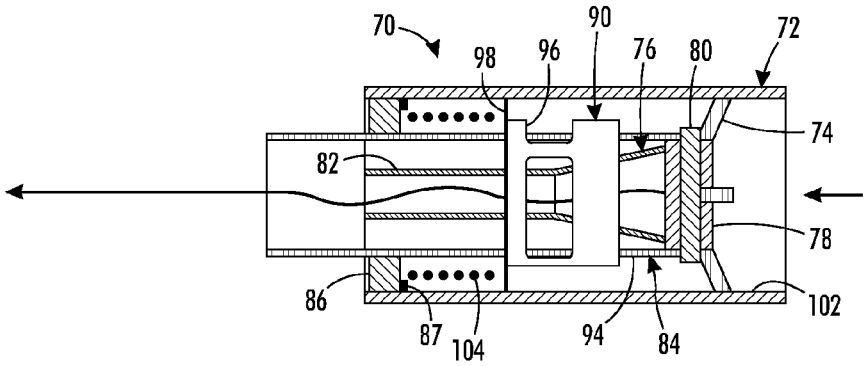

FIGS. 5A-5C depict the operation of an alternative exhaust regulating system mounted in a duct section of an exhaust conduit with FIG. 5A depicting a possible low-speed operating position, FIG. 5B depicting a possible mid-speed operating position, and FIG. 5C depicting a possible high-speed operating position.

Figure 6A:
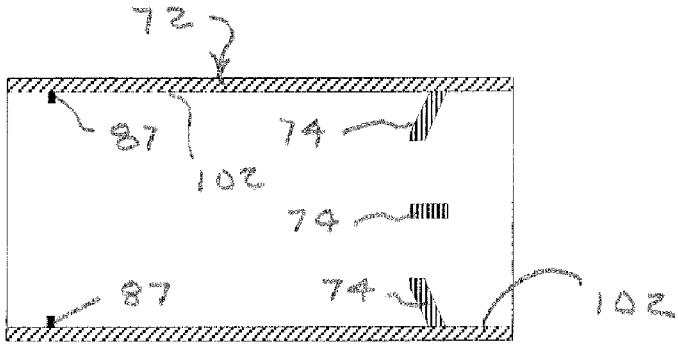
Figure 6B:
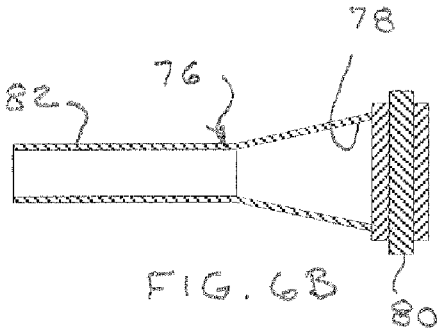
Figure 6C:
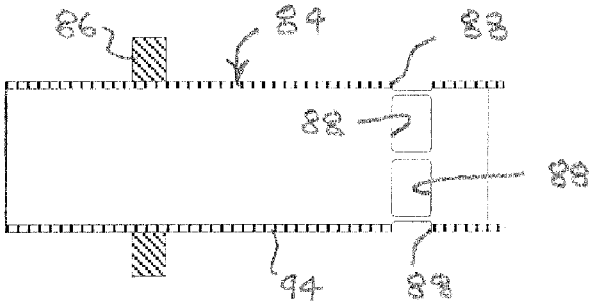
Figure 6D:
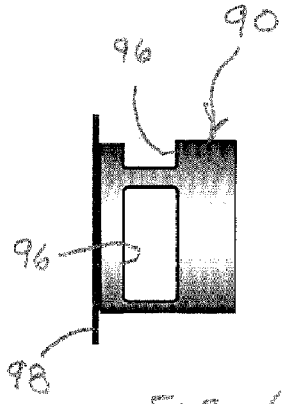

FIGS. 6A-6D illustrate key components of the exhaust regulating system of FIGS. 5A-5C, including the duct section in FIG. 6A, a bypass tube in FIG. 6B, a regulator tube in FIG. 6C, and a piston in FIG. 6D.

DETAILED DESCRIPTION

Figure 1:
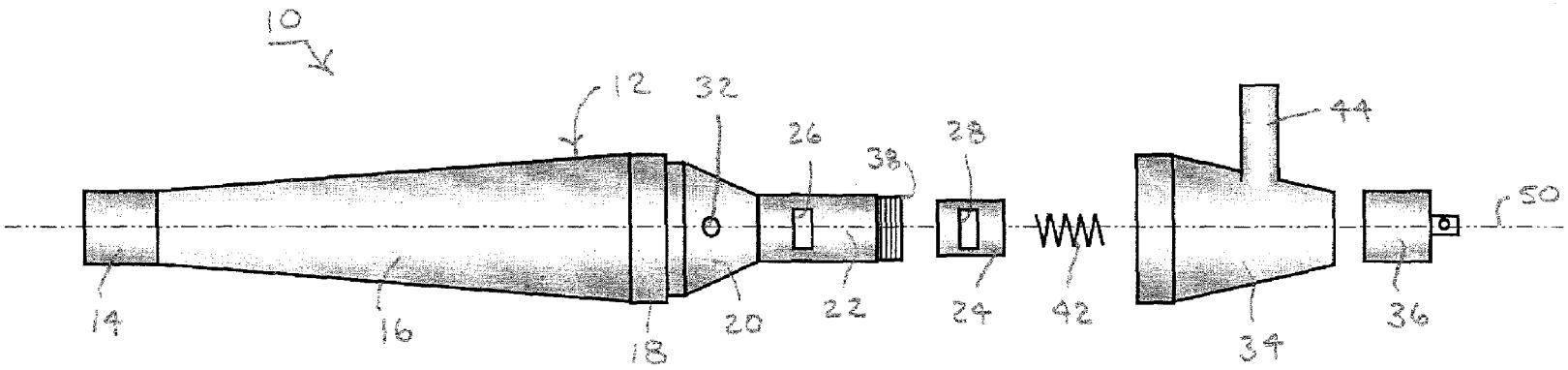
FIG. 1 is an exploded side view of an exhaust system in accordance with the invention showing both a bypass port and a regulator port within an exhaust conduit for influencing exhaust back pressures.

An exhaust system 10 shown in FIG. 1 includes a specially shaped exhaust conduit 12 having a coupling 14 for connecting the exhaust conduit 12 directly to an exhaust port two-cycle engine (not shown) or indirectly to the exhaust port through an inlet or head pipe (also not shown). In addition to the coupling 14, the exhaust conduit includes a diffuser section 16, a dwell section 18, a convergent section 20, and a duct section 22. Slideable within the duct section 22 is a displacer in the form of a piston 24. Both the duct section 22 and the piston 24 include similarly shaped openings 26 and 28 that cooperate to form a variably sized regulator port 30, which is shown in various stages of operation in FIGS. 4A-C. A bypass port 32 is formed as a fixed size opening in the convergent section 20 of the exhaust conduit 12.

An exhaust cone 34, which functions as a shroud, fits over the convergent section 20 and the duct section 22 protecting both ports 30 and 32 from environmental influences. A threaded end cap 36 engages a similarly threaded end 38 of the duct section 22, holds the exhaust cone 34 in place against the dwell section 18 of the exhaust conduit 12, and closes the threaded end 38 of the duct section 22. A regulator spring 42 extends between the piston 24 and the end cap 36 for biasing the piston 24 into an initial operating position within the duct section 22. An outlet pipe 44 emerges from the exhaust cone 34 to discharge exhaust gases passing through the variably sized regulator port 30 and fixed size bypass port 32 to atmosphere (i.e., the surrounding environment).

Figure 2:
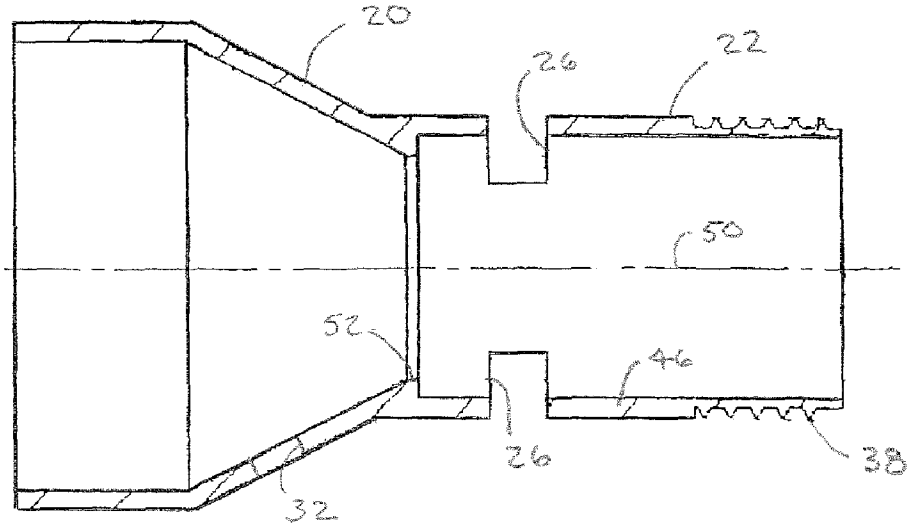
FIG. 2 is an enlarged cross-sectional side view of a portion of the exhaust conduit that functions as a valve body.
Figure 3:
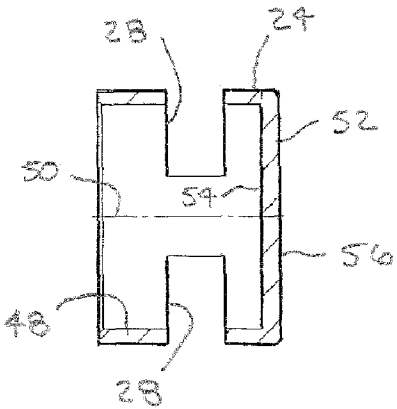
FIG. 3 is a similarly enlarged cross-sectional side view of a piston that functions as a spool within the valve body.

Enlarged cross-sectional views of the convergent and duct sections 20 and 22 of the conduit 12 and the piston 24 are shown in FIGS. 2 and 3. The duct section 22 and the piston 24 are both hollow structures that include pairs of openings 26 and 28 formed through their respective sidewalls 46 and 48. The duct section 22, which functions as a valve body, includes an open end 52 that receives exhaust gases from the two-cycle engine. The threaded end cap 36 closes the threaded end 38 of the duct section 22. Thus, the exhaust gases that are discharged through the outlet pipe 44 must pass through either the bypass port 32 in the convergent section 20 or the openings 26 in the duct section 22 as regulated by their overlap with the openings 28 in the piston 24.

The piston 24, which has an overall cylindrical form and functions as a valve spool, includes a piston head 52 at one end of the hollow-structured sidewalls 48. An inner surface 54 of the piston head 52 is exposed to the flow of exhaust gases, and an outer surface 56 of the piston is engaged by the regulator spring 42. The position of the piston 24 along an axis 50 of the exhaust conduit 12 is determined as a balance between the forces exerted by the flow of exhaust gases and the opposing biasing forces exerted by the regulator spring 42. The piston 24 and the duct section 22 together with their respective openings 28 and 26 form a regulator valve 60 that regulates the size of the regulator port 30 for imposing a variable resistance to exhaust flows through the regulator port 30.

FIGS. 4A-C depict the relative positions of the piston 24 within three different operating speed ranges of the two-cycle engine. At a low range of operating speeds depicted in FIG. 4A, the piston 24 is biased by the regulator spring 42 toward an initial default position at which the openings 28 of the piston 24 are substantially out of alignment with the openings 26 in the duct section 22. In the position of the piston 24 shown in FIG. 4A, the regulator valve 60 substantially closes the variably sized regulator port 30 imposing a resistance to exhaust flows through the regulator port 30. Nonetheless, the fixed size bypass port 32 provides a minimum flow area for exhaust gases to escape the exhaust conduit 12 throughout the entire range of engine operating speeds. Both the fixed size of the bypass port 32 and the initial size of the variably sized regulator port 30 can be set according to the demands of different two-cycle engines.

As exhaust flows increase accompanying an increase in engine operating speed, the piston 24 is displaced, compressing the regulator spring 42 and progressively opening the regulator valve 60 by moving the openings 28 of the piston 24 into better alignment within the openings 26 in the duct section 22. As shown in FIG. 4B representing a condition of the regulator valve 60 within a mid range of engine operating speeds, the piston 24 is displaced into a position at which the openings 28 in the piston 24 overlap with the openings 26 in the duct section to fully open the regulator valve 60 and impose a minimum resistance to exhaust flows through the variably sized regulator port 30.

At the high range of engine speeds, particularly approaching the top-end speed, the regulator valve 60 progressively closes as depicted in FIG. 4C. A further displacement of the piston 24 moves the openings 28 out of alignment with the openings 26 in the duct section 22 so that the amount of overlap between the openings 26 and 28 through which exhaust gases can escape through the regulator port 30 is reduced. Depending on the maximum exhaust flow rates and the bias of the regulator spring 42, the regulator valve 60 can be nearly or completely closed at the top-end speed. The fixed size of the bypass port 32 provides a minimum flow area for exhaust gases to escape the exhaust conduit 12 independently of the operating condition of the regulator valve 60.

The operation of the regulator valve 60 through stages of progressively opening and closing over a range of increasing engine speeds is expected to have beneficial effects on the back pressure profile of the engine with respect to the back-pressure profiles possible from exhaust conduits having fixed size openings or from exhaust conduits that are just progressively opened over a range of increasing engine speeds. Horsepower output can be optimized over the range of engine operating speeds and particularly at top-end speeds. Moreover, the combination of the fixed size bypass port 32 with the variably sized regulator port 30 assures that the minimum exhaust discharge needs of the engine are met throughout the full range of operating speeds while the resistance to the flow of exhaust gases is regulated to meet engine needs at particular operating speeds.

Preferably, both the openings 26 in the duct section 22 and the openings 28 in the piston 24 have rectangular shapes oriented in parallel so that the size of the regulator port 30 varies linearly with the displacement of the piston 24. A single dimension of the size of the regulator port 30 is varied by the displacement of the piston 24, which occurs in the same direction as the dimension along the axis 50 of the exhaust conduit 12.

FIGS. 5A-5C depict the operation of an alternative exhaust regulating system 70 mounted in a duct section 72 of an exhaust conduit, such as the exhaust conduit 12 of the preceding embodiment. Key components of the exhaust regulating system 70 are individually illustrated in FIGS. 6A-6D.

Mounted along the duct section 72 are fingers 74 that support a central bypass tube 76 for discharging the exhaust gases. The bypass tube 76, which functions as a fixed size bypass port, has a funnel-shaped opening 78 surrounded by a flange 80 for engaging the fingers 74 and a tubular-shaped body 82 for discharging the exhaust gases. A regulator tube 84, which surrounds the bypass tube 76, is supported at one end by the flange 80 of the bypass tube 76 and includes a collar 86 along another portion of its length for engaging stops 87 of the duct section 72. The regulator tube 84 has regulated openings (or ports) 88 that function together with a piston 90 as a regulator valve 92. The piston 90, which is slidable along an outer bearing surface 94 of the regulator tube 84, has similarly shaped openings (or ports) 96 that are moveable into and out of alignment with the openings 88 in the regulator tube 84. In addition, the piston 90 has a surrounding ring 98 that forms at least a partial seal with an inner bearing surface 102 of the duct section 72. A regulator spring 104 extends between the piston ring 98 and the collar 86 of the regulator tube 84 for biasing the piston 90 in a direction opposed to the flow of exhaust gases through the exhaust regulating system 70.

The duct section 72, shown in isolation by FIG. 6A, supports the internal components, including the bypass tube 76, the regulator tube 84, and the piston 90, and regulates the egress the exhaust gases during engine operation through a combination of fixed and variably sized apertures. The duct section 72 is preferably made from a material, such as steel, that withstands the exhaust temperatures and is structurally strong enough to support the internal components during engine operations.

The bypass tube 76, shown in isolation by FIG. 6B, allows the exhaust gases to bypass the regulator valve 92 and creates low pressure on the opposite side of the regulator valve 92. On the inlet side of the bypass tube 76, the funnel-shaped opening 78 increases air speed of the exhaust gases for low engine speed operations. The bypass tube 76 is also made from a material, such as steel, that withstands the anticipated exhaust temperatures and is structurally strong enough to support other components during engine operations.

The regulator tube 84, shown in isolation by FIG. 6C, contains rectangular openings 88 on either side. The openings 88 are geometrically shaped and positioned relative to corresponding openings 96 in the piston 90. Support for the regulator tube 84 is provided by both the flange 80 of bypass tube 76 and the stops 87 of the duct section 72 via the collar 86. A snap ring (not shown) can also be used to hold the regulator tube 84 in place against the stops 87. This regulator tube 84 can be made from any material, such as steel or aluminum, that maintains the desired lubricity, can withstand the exhaust temperatures, and is structurally strong enough to support any dependent components during engine operations.

The piston 90, shown in isolation by FIG. 6D, has openings 96 on either side can be aligned with the openings 88 of the regulator tube 84 to allow additional exhaust gas flows through the exhaust regulating system 70. The piston 90 can be mounted internal or external of the regulator tube 84. The openings 88 and 96 can be relatively shaped and positioned to achieve desired operating levels. However, both openings 88 and 98 are preferably rectangular in shape so that flow area increases or decreases linearly with the translation of the piston 90. The piston ring 96 supports the regulator spring 104 and provides additional area exposed to exhaust flow pressures for translating the piston 90 along the regulator tube 84 by different amounts corresponding to different exhaust flow rates. The piston 90 can also be made from a material, such as steel or aluminum, that can withstand the expected exhaust temperatures.

The regulator spring 104, which is not separately illustrated, allows the piston 90 to adjust to varying engine conditions. The regulator spring 104 can be a varying rate type or a standard compression spring. Preferably, the regulator spring 104 is made from high-temperature stainless steel, such as 17-7 stainless steel, and is positioned for displacing with respect to the fixed collar 86 of the regulator tube 84.

The regulator valve 92 automatically controls the exhaust gas flow resistance during engine operation. On some engines, it was found that at low speeds it was more desirable to have less resistance and to have more resistance at high speed, where other engines have demonstrated the need for high resistance at low speed, then at mid-speed low resistance, and back to high resistance at high speed. Simply changing regulator port timing and spring rates can satisfy these different engine conditions. The regulator valve can be of the internal piston design or external piston design. The piston configuration is determined by performance need and or packaging. The self-contained regulator is preferably positioned within the duct section or tail pipe as shown in the drawing figures but can also be positioned elsewhere in the exhaust system.

FIG. 5A depicts a possible low-speed operating position for the alternative exhaust regulating system 70 where the bulk of the gases go straight through the bypass tube 76, where the gasses are both compressed and accelerated. The high-speed gases going through the bypass tube 76 assist the gases going through the aligned openings 88 and 96 in the regulator tube 84 and the piston 90. Both the regulated gasses passing through the regulating valve openings 88 and 96 and the remaining gases passing through the bypass tube 76 come together within the regulator tube 84 and continue together through their discharge to atmosphere.

FIG. 5B depicts a possible mid-speed operating position where increases in exhaust pressure accompany increases in flow rates. The piston 90 responds to the increased flow rates by compressing the regulator spring 104 and displacing the openings 96 in the piston with respect to the openings 88 in the regulator tube 84. That is, as the piston 90 moves back, the regulator valve 92 starts to close reducing the flow of regulated exhaust gases. The full flow of exhaust gasses remain able to go through the bypass tube 76.

FIG. 5C depicts a possible high-speed operating condition such as wide-open throttle, where engine speed is at maximum rpm's and the exhaust pressure is at maximum. The peak exhaust flow causes the piston 90 to move against the resistance of the regulator spring to completely closing the regulator valve 92. The nearly full flow of exhaust gasses passes through the bypass tube 76.

The invention is particularly applicable to two-cycle hobby engines but is also expected to provide similar benefits for other two-cycle engines. In addition, while the invention has been described in particular with respect to its preferred embodiment, those of skill in the art will readily appreciate that the invention can be expressed in a variety of other embodiments. For example, other exhaust conduit and valve configurations can be used in accordance with the teachings of the invention, including valves responsive to engine speeds independently of the exhaust gases.

What is claimed is:

1. A valve system for regulating exhaust flows from a two-cycle engine comprising a valve body containing a port for directing exhaust gases from the two-cycle engine toward atmosphere, a displacer being relatively moveable with respect to the valve body in response to exhaust flows through the valve body for regulating an effective size of the port, and the displacer being responsive to increasing exhaust flow rates through the valve body by increasing the effective size of the port within a first lower range of the increase in exhaust flow rates and by decreasing the effective size of the port within a second higher range of the increase in exhaust flow rates.

2. The valve system of claim 1 in which the displacer includes an opening that is movable into and out of alignment with an opening in the valve body for increasing and decreasing the effective size of the port.

3. The valve system of claim 2 in which the displacer is a piston having a head exposed to the exhaust flow and a sidewall containing the opening in the displacer that is movable into and out of alignment with the opening in the valve body.

4. The valve system of claim 3 in which the valve body and is formed in an exhaust conduit of an exhaust system for the two-cycle engine and the opening in the valve body is formed in a sidewall of the exhaust conduit.

5. The valve system of claim 4 in which the piston is displaceable by exhaust flows within the exhaust conduit for moving the opening in the sidewall of the piston into and out of alignment with the opening in the exhaust conduit.

6. The valve system of claim 3 in which the valve body includes first and second ends that straddle the opening in the valve body, the first end of the valve body being open for receiving exhaust flows, and the head of the piston being located between the opening in the valve body and the second end of the valve body through the second higher range of the increase in exhaust flow rates.

7. The valve system of claim 6 in which the sidewall of the piston has a hollow cylindrical form that overlaps the opening in the valve body.

8. The valve system of claim 7 in which the second end of the valve body is substantially closed, and a biasing member is located between the second end of the valve body and the head of the piston.

9. The valve system of claim 2 in which the openings in the valve body and the displacer have rectangular forms so that the effective size of the port increases and decreases linearly with the movement of the displacer with respect to the valve body.

10. The valve system of claim 1 further comprising a bypass port for separately directing exhaust gases from the two-cycle engine toward the atmosphere.

11. The valve of claim 10 in which the bypass port has a fixed size through which the exhaust gases are directed toward the atmosphere.

12. An exhaust system for regulating exhaust flows from a two-cycle engine comprising an exhaust conduit for conveying exhaust gases from the two-cycle engine, first and second ports formed in the exhaust conduit for discharging the exhaust gases from the exhaust conduit, a valve for regulating the discharge of the exhaust gases from the exhaust conduit, the first port having a fixed size along the exhaust conduit for discharging exhaust gases independently of the valve, the second port having an effective size adjusted by the valve for regulating back pressures in the exhaust conduit, the first port being located along the exhaust conduit in advance of the second port in the direction of exhaust flow, the second port being located within a substantially cylindrical section of the exhaust conduit, and the first port being located within a substantially conical section of the exhaust conduit.

13. An exhaust system for regulating exhaust flows from a two-cycle engine comprising an exhaust conduit for conveying exhaust gases from the two-cycle engine, first and second ports formed in the exhaust conduit for discharging the exhaust gases from the exhaust conduit, a valve for regulating the discharge of the exhaust gases from the exhaust conduit, the first port having a fixed size along the exhaust conduit for discharging exhaust gases independently of the valve, the second port having an effective size adjusted by the valve for regulating back pressures in the exhaust conduit, the first port being located along the exhaust conduit in advance of the second port in the direction of exhaust flow, and a shroud that at least partially covers the second port for protecting the valve from effects of external exposure.

14. The exhaust system of claim 13 in which the adjustable size second port has a variable cross-sectional area and the fixed size first port has a constant cross-sectional area.

15. The exhaust system of claim 14 in which the valve includes a displacement member that is movable along the exhaust conduit in response to changes in exhaust flows through the exhaust conduit.

16. The exhaust system of claim 15 in which the flow cross-sectional area of the adjustable size second port varies linearly with the movement of the displacement member along the exhaust conduit.

17. An exhaust system for regulating exhaust flows from a two-cycle engine comprising an exhaust conduit for conveying exhaust gases from the two-cycle engine, first and second ports formed in the exhaust conduit for discharging the exhaust gases from the exhaust conduit, a valve for regulating the discharge of the exhaust gases from the exhaust conduit, the first port having a fixed size along the exhaust conduit for discharging exhaust gases independently of the valve, the second port having an effective size adjusted by the valve for regulating back pressures in the exhaust conduit, and the valve being responsive to exhaust flows through the exhaust conduit by progressively opening the second port in response to increasing exhaust flows and by at least partially closing the second port in response to further increasing exhaust flows.

18. An exhaust system for regulating exhaust flows from a two-cycle engine comprising an exhaust conduit for conveying exhaust gases from the two-cycle engine, a port formed in the exhaust conduit for discharging the exhaust gases from the exhaust conduit, a valve being responsive to exhaust flows through the exhaust conduit by progressively opening the port in response to increasing exhaust flows and by at least partially closing the port in response to further increasing exhaust flows.

19. The exhaust system of claim 18 in which the port is one of a plurality of ports and another of the ports has a fixed size for bypassing exhaust flows in advance of the valve.

20. The exhaust system of claim 18 in which the valve includes a displacement member that is movable along the exhaust conduit in response to changes in exhaust flows through the external conduit.

21. The exhaust system of claim 20 in which the port has an adjustable size that varies in size with the movement of the displacement member along the exhaust conduit.

22. The exhaust system of claim 21 in which the size of the port progressively increases through a first range of movement of the displacement member and progressively decreases through a second range of movement of the displacement member in the same direction along the exhaust conduit.

23. The exhaust system of claim 22 in which the exhaust conduit has an open end for receiving exhaust flows from the two-cycle engine, a closed end, and a sidewall in which the port is formed.

24. The exhaust system of claim 23 in which the displacement member has a head that is exposed to the exhaust flows and a sidewall that is aligned with the sidewall of the exhaust conduit for adjusting the size of the port, the head having a first side facing the open end of the exhaust conduit and a second side facing the closed end of the exhaust conduit.

25. A method of controlling resistance to exhaust flows in an exhaust system of a two-cycle engine comprising steps of imposing a resistance to the exhaust flows in the exhaust system at low range of operating speeds of the two-cycle engine, progressively decreasing the resistance to the exhaust flows in the exhaust system through a mid range of increasing operating speeds of the two-cycle engine, and increasing the resistance to the exhaust flows in the exhaust system at a high range of operating speeds of the two-cycle engine.

26. The method of claim 25 in which the step of increasing includes progressively increasing the resistance to the exhaust flows in the exhaust system through the high range of increasing operating speeds of the two-cycle engine.

27. The method of claim 25 in which the resistance to the exhaust flows is provided by a valve that progressively opens in response to exhaust flows associated with increasing operating speeds of the two cycle engine within the mid range of engine speeds and progressively closes in response to exhaust flows associated with further increasing operating speeds of the two-cycle engine within the high range of engine speeds.

28. The method of claim 25 including a step of bypassing the resistance with a portion of the exhaust flow to atmosphere.

29. An exhaust system for regulating exhaust flows from a two-cycle engine comprising an exhaust conduit for conveying exhaust gases from the two-cycle engine, a port formed in the exhaust conduit for discharging the exhaust gases from the exhaust conduit, and a valve being responsive to exhaust flows through the exhaust conduit by linearly varying the effective size of the port in response to an increase in exhaust flow rates, wherein the valve progressively closes the port in response to the increase in exhaust flow rates.

30. An exhaust system for regulating exhaust flows from a two-cycle engine comprising an exhaust conduit for conveying exhaust gases from the two-cycle engine, a port formed in the exhaust conduit for discharging the exhaust gases from the exhaust conduit, and a valve being responsive to exhaust flows through the exhaust conduit by linearly varying the effective size of the port in response to an increase in exhaust flow rates, wherein the valve progressively opens the port in response to increasing exhaust flows and the valve at least partially closes the port in response to further increasing exhaust flows.

31. The exhaust system of claim 30 in which the valve includes a displacement member that is movable along the exhaust conduit in response to changes in exhaust flows through the external conduit and the port has an adjustable size that varies in size with the movement of the displacement member along the exhaust conduit.

32. The exhaust system of claim 30 further comprising a bypass port for separately directing exhaust gases from the two-cycle engine toward the atmosphere.

33. The exhaust system of claim 32 in which the bypass port has a fixed size through which the exhaust gases are directed toward the atmosphere.

* * * * *